US006736668B1

(12) United States Patent
Kholodenko et al.

(10) Patent No.: US 6,736,668 B1
(45) Date of Patent: May 18, 2004

(54) HIGH TEMPERATURE ELECTRICAL CONNECTOR

(76) Inventors: Arnold V. Kholodenko, 1747 Eucalyptus Dr., San Francisco, CA (US) 94132; Senh Thach, 32257 Jean Dr., Union City, CA (US) 94587; Wing L. Cheng, 1665 Lachine Dr., Sunnyvale, CA (US) 94087; Alvin Lau, 1823 Lake St., San Francisco, CA (US) 94121; Dennis S. Grimard, 511 Liberty Pointe, Ann Arbor, MI (US) 48103

( * ) Notice: Subject to any disclaimer, the term of this patent is extended or adjusted under 35 U.S.C. 154(b) by 0 days.

(21) Appl. No.: 09/663,864

(22) Filed: Sep. 15, 2000

(51) Int. Cl.[7] ..... H01R 13/00
(52) U.S. Cl. ..... 439/487; 439/485
(58) Field of Search ..... 439/654, 485, 439/487, 564; 174/159

(56) References Cited

U.S. PATENT DOCUMENTS 3,171,990 A * 3/1965 Bennett ..... 174/151
4,058,671 A * 11/1977 Panek et al. ..... 174/12 R
4,088,381 A * 5/1978 Harnett ..... 174/151
4,380,362 A * 4/1983 Swensrud et al. ..... 439/487
4,458,220 A * 7/1984 Carter et al. ..... 333/182
4,473,267 A * 9/1984 Sadigh-Behzadi ..... 439/271
4,842,683 A 6/1989 Cheng et al. ..... 156/345
4,963,694 A * 10/1990 Alexion et al. ..... 174/15.6
5,015,202 A * 5/1991 Blumentritt et al. ..... 439/194
5,110,307 A * 5/1992 Rapoza ..... 174/152 GM
5,947,766 A * 9/1999 Tsuji et al. ..... 439/559
6,151,203 A 11/2000 Shamouilian et al. ..... 361/234
6,175,083 B1 * 1/2001 Palmer et al. ..... 174/151

* cited by examiner

*Primary Examiner*—P. Austin Bradley
*Assistant Examiner*—Edwin A. Leon
(74) *Attorney, Agent, or Firm*—Moser, Patterson & Sheridan, LLP; Joseph Bach

(57) ABSTRACT

An electrical coupler comprises an inner connector having upper and lower ends, an insulative outer connector element circumscribing the inner connector, and a thermally conductive flange disposed over the upper end of the inner connector and the outer connector for conducting heat from the electrical conductor. The electrical conductor may be utilized in a substrate support for semiconductor wafer processing. The substrate support comprises a chuck body having an electrode embedded therein, and an upper male connector coupled to the electrode and protruding from said chuck body. A cooling plate having the electrical coupler is positioned proximate to the chuck body. The upper male connector is inserted in the electrical coupler, and a power source coupled to the lower portion of the electrical coupler chucks and biases a wafer to an upper surface of said chuck. The thermally conductive flange conducts and transfers heat generated from the upper male connector and electrical coupler to the cooling plate.

22 Claims, 4 Drawing Sheets

HIGH TEMPERATURE ELECTRICAL CONNECTOR

BACKGROUND OF THE INVENTION

1. Field of the Invention

This invention relates to electrostatic chucks for retaining a semiconductor wafer in a semiconductor wafer processing system and, more specifically, to connectors for connecting power to an electrode embedded in a chuck.

2. Description of the Background Art

Numerous electrostatic chucks are known to the art for retaining a semiconductor wafer within a process chamber of a semiconductor wafer processing system. A semiconductor wafer processing system is disclosed in U.S. Pat. No. 4,842,683 entitled MAGNETIC FIELD-ENHANCED PLASMA ETCH REACTOR, David Cheng et al issued Jun. 27, 1989, and assigned to the same assignee as the present application, Applied Materials, Inc., of Santa Clara, Calif. This patent is incorporated herein by reference as if fully reproduced herein.

Specifically, the chuck 10 includes a chuck body 12 of ceramic material, such as for example aluminum nitride, and further includes an electrode 14 embedded in the chuck body 12, near the top portion thereof. The embedded electrode 14 may be, for example, a molybdenum mesh electrode. The electrode 14 is coupled to a power supply through an electrical coupler 16. The electrical coupler 16 includes a male connector member 18 and a female connector member 20, typically fabricated from molybdenum and beryllium copper, respectively. The chuck 10 is attached to a cooling plate 22 suitably mounted to the bottom of the chuck body 12 such as for example by a suitable adhesive or by suitable bolts not shown. The cooling plate 22 may be made, for example, of stainless steel or aluminum and is provided with a plurality of cooling channels 21 for carrying a liquid coolant for cooling the chuck 10. The male connector member 18 includes an upper solid cylindrical portion 24 extending through a bore 25 formed in the chuck body 12 and an integrally formed lower solid cylindrical portion 26 extending through a bore 27 formed in the cooling plate 22. Lower cylindrical portion 26 has a smaller diameter than the upper cylindrical portion 24. The female connector member 20 is provided with an inwardly extending upper cylindrical bore 28 forming a collet 29. The cylindrical bore 28 and collet 29 receive the lower cylindrical portion 26 of the male connector member 18 along path 37, thereby mechanically and electrically interconnecting the male and female connector members 18 and 20 together. The female connector member 20 is fixed within an insulator portion 11 of a pedestal base (not shown). The bottom of the female connector member 20 is connected to a source of RF biasing power 30 and a source of DC chucking voltage 32 by a connector 34 and a conductor 35.

Certain semiconductor wafer processes require that the chuck operate at a relatively elevated temperature, for example, from about 200° C. to about 500° C. Accordingly, the temperatures of the male and female connector members 18 are increased in the same temperature range with little reduction in temperature. Such components, especially the lower portion of the female connector member 20, which is coupled to the electrical connector 34 and conductor 35 for applying the RF and DC biasing voltage, must be able to withstand these operating temperatures. An undesirable outcome of operating a chamber at such elevated temperatures is an increase in the costs for manufacturing the connector and conductor, since they are generally not commercially available.

Accordingly, there is a need in the semiconductor wafer chuck art for a chuck that is operated at a relatively high temperature in the range noted above. Furthermore, there is a need for a connector for applying the DC chucking voltage and the RF biasing power to the chuck electrode, which includes thermal impedance that assists in reducing the heat transferred between the top portion of the connector and the bottom portion of the connector. Additionally, there is a need for a connector that will not be subjected to the detrimental effects of plasma that may form between the male and female portions of the connector or any other surface area, having a different voltage potential than the top portion of the connector.

SUMMARY OF THE INVENTION

An electrical coupler comprises an inner connector having upper and lower ends, the insulative outer connector element circumscribing the inner connector, and a thermally conductive flange disposed over the upper end of the inner connector and the outer connector for conducting heat from the electrical conductor.

In another aspect, a support assembly for supporting a semiconductor wafer comprises a chuck body having at least one electrode embedded therein, and a cooling plate positioned beneath the chuck body. An electrical coupler is positioned within the cooling plate and has a thermally conductive flange circumscribing the electrical coupler and disposed upon a surface of the cooling plate.

DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
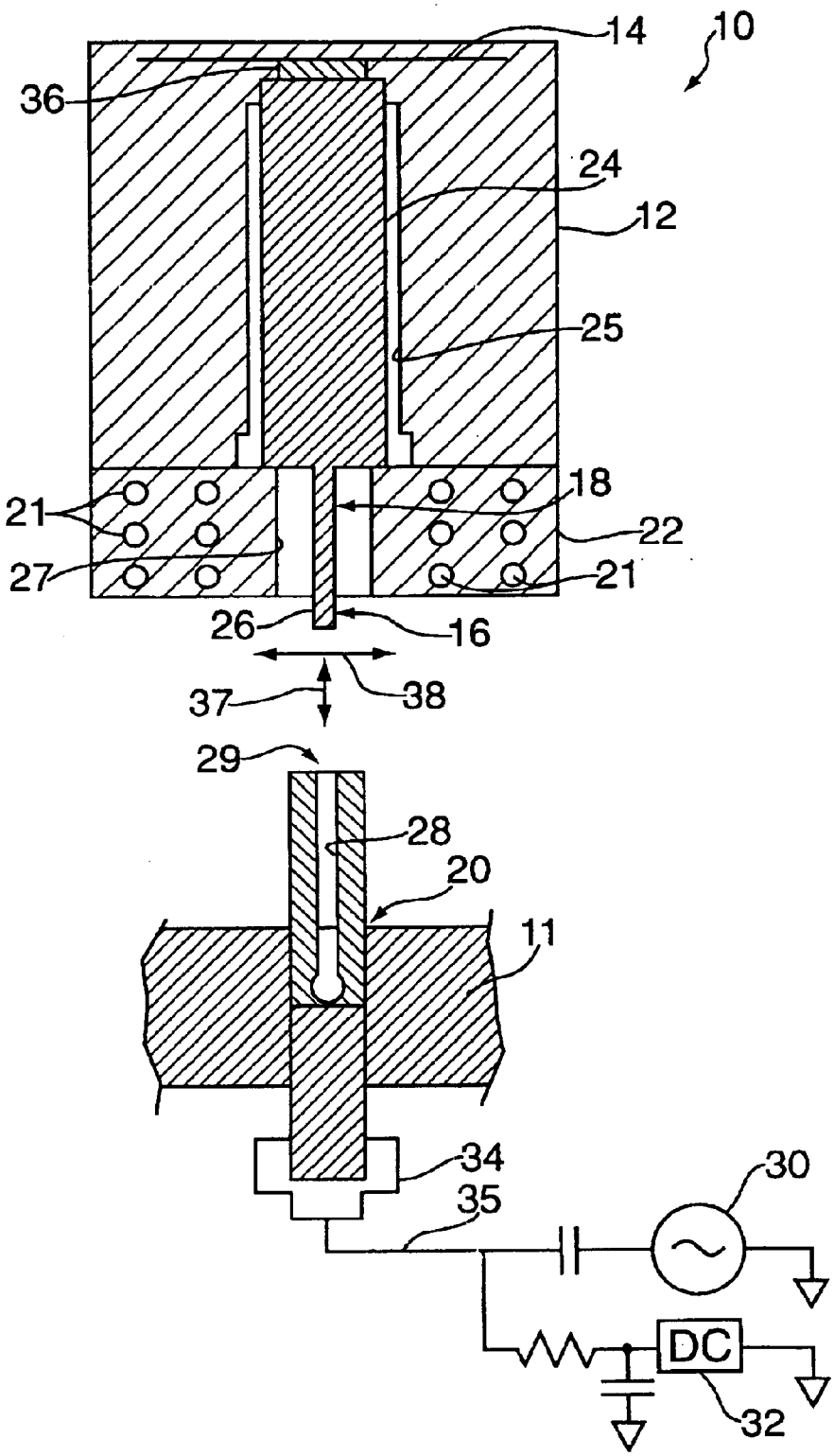
FIG. 1 PRIOR ART
FIG. 1 is a vertical elevational view, generally in cross-section, of a prior art semiconductor wafer chuck and connector.
Figure 2:
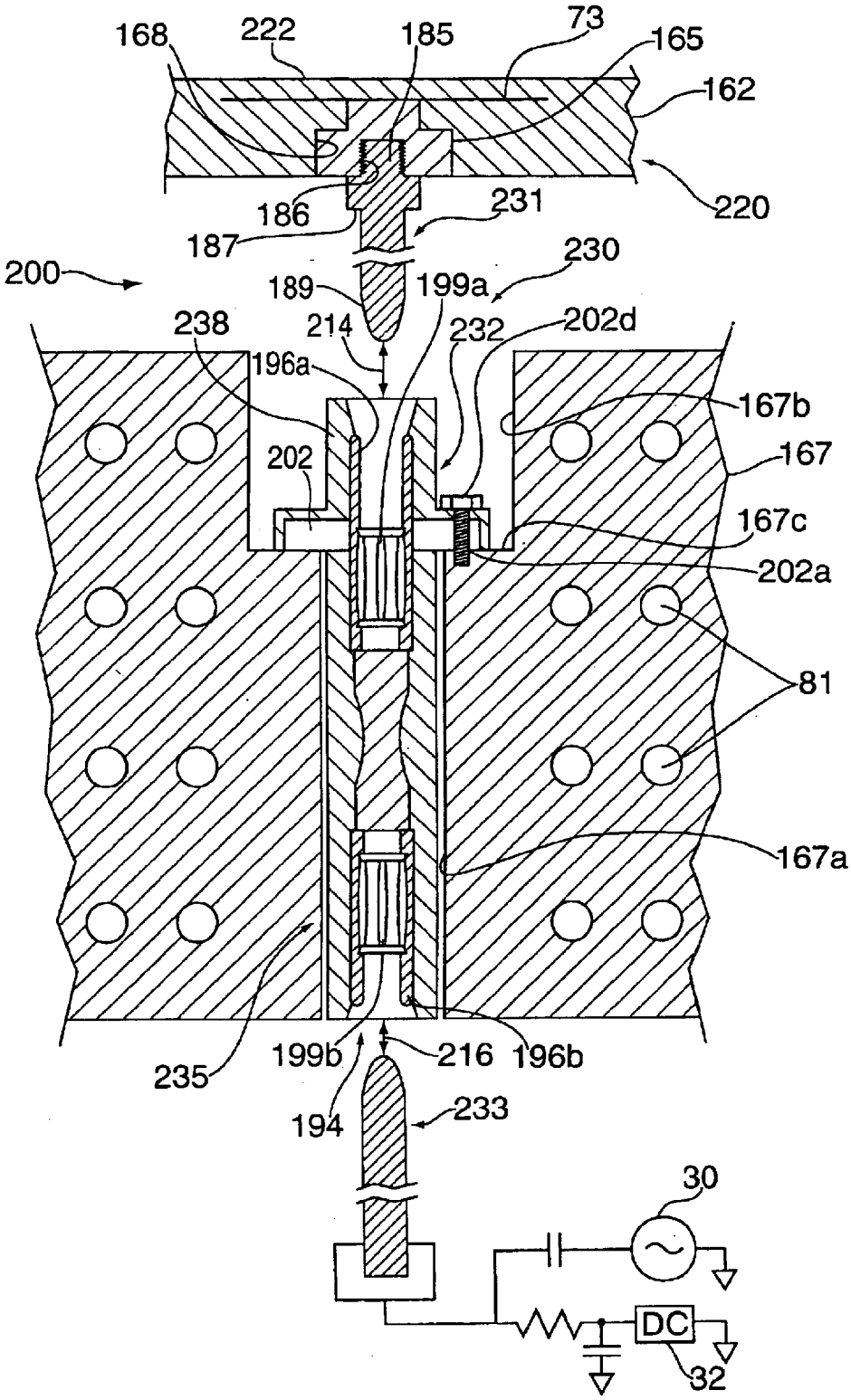
FIG. 2 is a partially exploded elevation view, in cross-section, of a semiconductor wafer support and connector of the present invention.

FIG. 2 depicts a semiconductor wafer support 200 having an electrical coupler in accordance with the present invention. In particular, the semiconductor wafer support 200 comprises a chuck 220 coupled to a cooling plate 167 having an electrical coupler 230, and a power source 28. A work piece such as a semiconductor wafer (i.e., substrate) is disposed upon an upper surface of the chuck 220. The wafer (not shown) is chucked and biased by an electrode 73 coupled to the power source 28 via the electrical coupler 230. Additionally, the preferred embodiment inventively utilizes a thermally conductive flange 202 (to be discussed in detail) for transferring heat from the electrical coupler 230 to the cooling plate 167. A semiconductor wafer processing system is disclosed in U.S. Pat. No. 6,151,203, entitled CONNECTORS FOR AN ELECTROSTATIC CHUCK AND COMBINATION THEREOF, by Shamoulian et al., issued Nov. 21, 2000 and assigned to the same assignee as the present application, Applied Materials, Inc., of Santa Clara, Calif. This patent application is incorporated herein by reference as if fully reproduced herein.

Specifically, the chuck 220 comprises a chuck body 162 having the electrode 73 embedded therein and an upper male connector 231 coupled to the electrode 73 via a chuck electrode connector 165. The electrode connector 165 resides in a centrally formed, generally cylindrical bore 168 extending upwardly into the chuck body 162 and opening to the electrode 73. In a preferred embodiment, the electrode connector 165 is mechanically and electrically connected to the electrode 73 by brazing, although other electrically conductive techniques may be used.

The chuck body 162 may be a ceramic material such as aluminum nitride, the electrode 73 may be a molybdenum mesh electrode, and W&e electrode connector 165 may be a molybdenum electrode connector plated with an electrically conductive material for conducting RF biasing power to the embedded electrode 73. Such plating material may be selected from the group comprising silver, gold, aluminum, nickel, copper, and any combination of metals thereof A person skilled in the art will recognize that other ceramic materials way be used to fabricate the chuck body 162 such as boron nitride and the like. Furthermore, other materials may be used to fabricate the electrode 73, as well as configure the electrode 73 in concentric circles, a coil shape, zoned configurations, and the like.

The upper male connector 231 is a solid, generally cylindrical connector member fabricated from a thermally non-conductive meal. In the preferred embodiment, the upper male connector 231 is stainless steel. At the top of the upper male connector 231 is an integrally formed threaded projection 185 for threadedly engaging the internal threads provided in the bore 186 of the electrode connector 165 to mechanically and electrically interconnect the upper male connector 231 to the embedded electrode 73. In particular, at the top of the upper male connector 231 is a radially extending portion 187 that serves as a conductive RF path as between the upper male connector 231 and the electrode connector 165. The conductive RF path is formed after we threaded projection 185 is threaded into the bore 186 of the electrode connector 165 so that the radially extending portion 187 is flush against the electrode connector 165. Thus, the conductive RF path follows along the upper male connector 231, through the radially extending portion 187 to electrode connector 165, and then to the electrode 73. However, one skilled in the aft will recognize that the chuck body 162, the chuck electrode connector 165, and the upper male electrode connector 231 may be coupled in any other manner suitable for rigidly securing each component together and providing an RF conductive path.

The upper male connector 231 is generally conical or has a tapered distal end 189. Moreover, the upper male connector 231 may be plated with electrically conductive material or successive layers of conductive materials such as aluminum, copper, silver, gold, and nickel. In the preferred embodiment, the plating is a successive layer of nickel, copper, nickel, and gold. In particular, the plating is performed to enhance RF current conduction, reduce the susceptibility to corrosion, minimize magnetic susceptibility, and minimize contact resistance between the upper male connector 231 and its female counterpart of the electrical coupler 230.

The cooling plate 167 is provided with a centrally formed generally cylindrical bore 167*a* whose top portion is provided with a counter bore 167*b*. A bottom of the counter bore 167*b* defines an annular mounting surface 167*c* for mounting an upper portion 232 of the electrical coupler 230. The electrical coupler 230 is inserted into the cylindrical bore 167*a* such that the upper portion 232 is affixed to the annular mounting surface 167*c*, for example, by suitable bolts 202*d* or by a suitable adhesive (not shown). Additionally, the cooling plate 167 may be fabricated from aluminum and is provided with a plurality of cooling channels 81 for receiving a suitable coolant fluid for cooling the chuck 220.

The electrode 73 that is embedded in the chuck 220 is electrically coupled to the chucking and biasing power sources 32 and 30, via the electrical coupler 230. Specifically, the upper male connector 231 is inserted into the upper portion 232 of the electrical coupler 230 disposed in the cooling plate 167, in blind assembly of the chuck body 162, along path 214 as shown in FIG. 2. The chucking power supply 32 and a biasing power supply 30 are each coupled to the electrical coupler 230 via a lower male connector 233. The lower male connector 233 is a solid, generally cylindrical connector member having a generally conical or tapered distal end. In the preferred embodiment the lower male connector 233 is copper or beryllium copper. Furthermore, the lower male connector 233 is inserted into a female counterpart at a lower end 235 of the electrical coupler 230 along path 216 as shown by the arrows in FIG. 2. In this manner, RF biasing power from the biasing power supply 30 and DC chucking voltage from the chucking power supply 32 are supplied to the embedded electrode 73 via the electrical coupler 230.

Figure 3A:
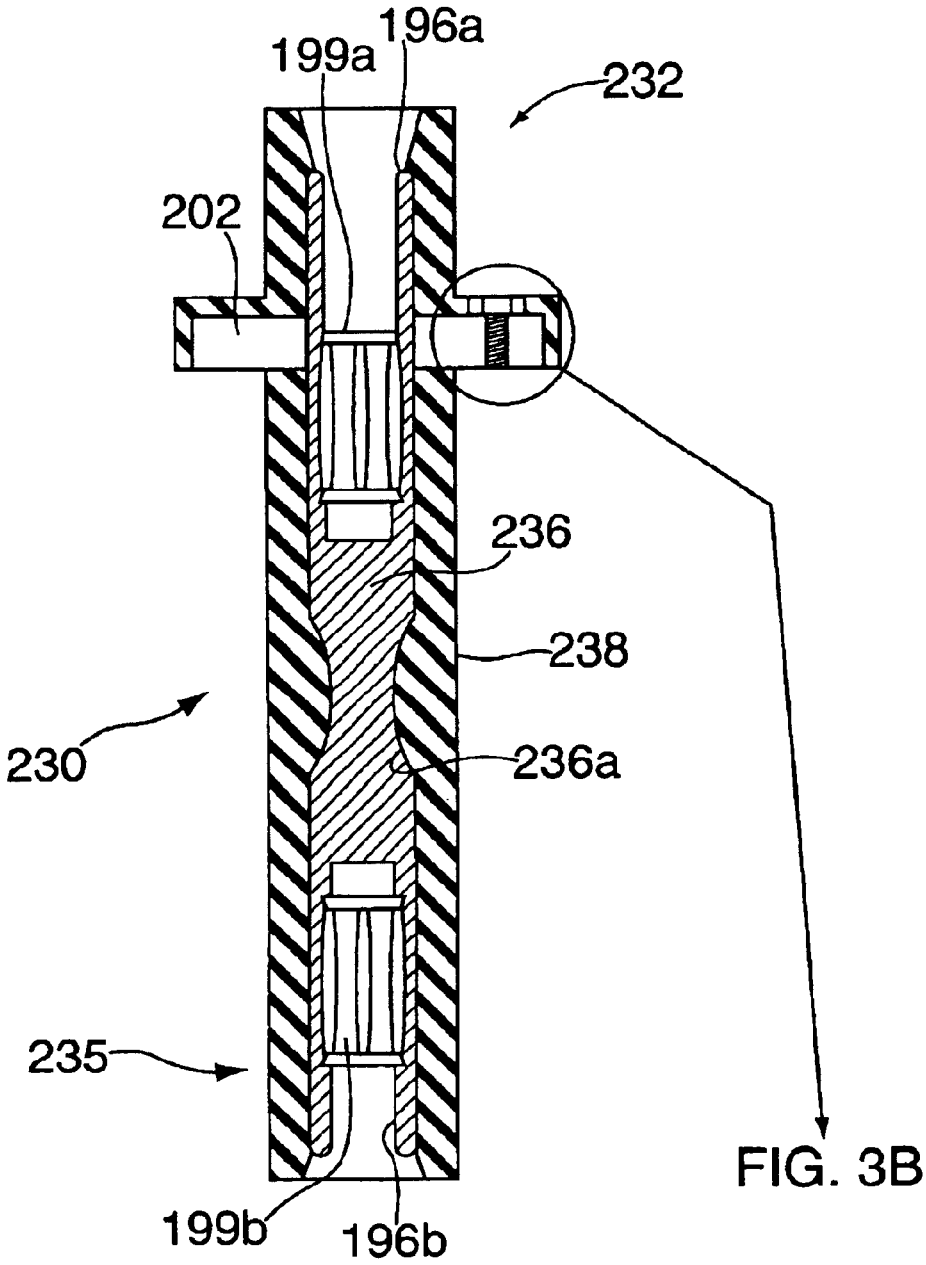
FIG. 3A is a detailed elevated cross-sectional view of an electrical coupler 230 shown in FIG. 2.

FIG. 3A is a detailed elevated cross-sectional view of an electrical coupler 230 shown in FIG. 2. The electrical coupler 230 comprises an upper portion 232, a lower portion 235, an inner connector element 236, and an outer connector element 238 disposed over the length of the electrical coupler 230. The inner connector element 236 is a solid generally cylindrical central portion having a pair of bores at its opposed, i.e., upper and lower ends. The bores generally define integral, hollow and annular cylindrical portions 196*a* and 196*b* (collectively, hollow cylindrical portions 196). Inserted into each hollow cylindrical portion 196 are resilient connector portions, such as female banana connectors 199*a* and 199*b* (collectively, banana connectors 199). Each female banana connectors 199 may be pressed-fitted into one of the hollow cylindrical portions 196*a* and 196*b*. As such, the banana connectors 199 are in mechanical and electrical engagement with the hollow cylindrical portions 196 and inner connector element 236. Additionally, the inner connector element 236, hollow cylindrical portions 196*a* and 196*b*, and the female resilient banana connectors 199*a* and 199*b*, in the preferred embodiment are beryllium copper, and may be plated with an electrically conductive material to enhance RF current conduction. Such electrically conductive material may be chosen from the group consisting of silver, gold, and nickel. Alternatively, the RF current conduction plating material may be successive layers of nickel and gold.

The outer connector element 238 is an electrically non-conductive element and serves as an isolator for electrically insulating or isolating the inner connector element 236 from the cooling plate 167 and for eliminating air gaps and RF arcing therebetween. In one embodiment, the outer connector element 238 is fabricated from silicone and is molded about the entire length of the inner connector element 236 so as to be in intimate contact with the outer surface 236*a* of the inner connector element 236. Such intimate contact prevents RF arcing between the conductive inner connector element 236 and its surrounding environment. Additionally, the outer connector element 238 may extend for a length that circumscribes the annular cylindrical portion 196*b* at the lower portion 235 as well as the upper portion 232 of the electrical coupler 230. Accordingly, the insertion of the upper and lower male connectors 231 and 233 into the female resilient banana connectors 199*a* and 199*b* at the respective top and bottom of the electrical coupler 230, thereby mechanically and electrically couple the electrode 73 to the power sources 30 and 32. In addition, the upper male connector 231 and the cooling plate 167 provide a thermal path such that the heat generated from the thermally non-conductive stainless steel male connector 231 is conducted to the cooling plate 167.

Figure 3B:
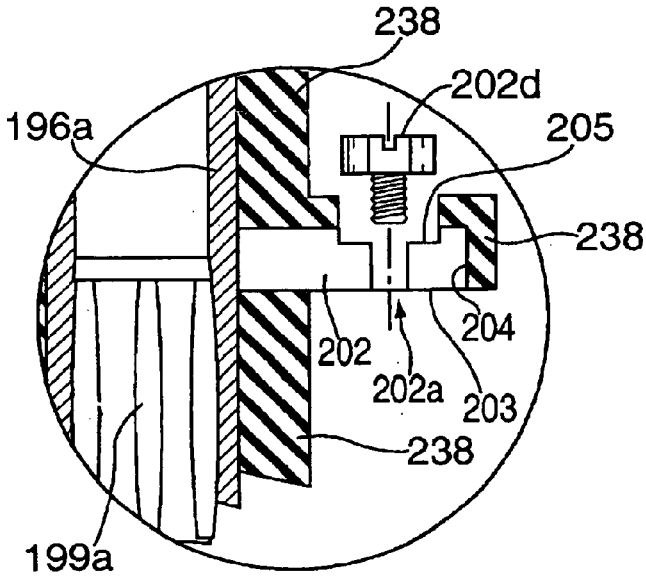
FIG. 3B is a detailed view of the circled portion of the electrical coupler shown in FIG., 3A.
Figure 4:
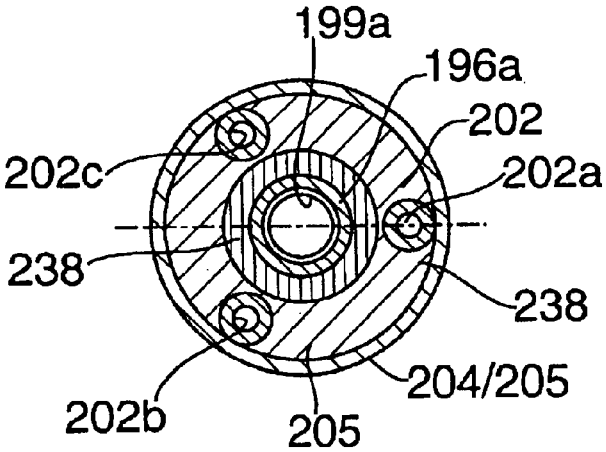
FIG. 4 depicts a top view of the electrical coupler.

Referring to FIGS. 3A, 3B and 4, it will be further understood that the electrical coupler 230 includes a flange 202 that is fabricated from a thermally conductive, yet electrically insulative material such as a ceramic material. Preferrably, the thermally conductive flange 202 is fabricated from a material selected from the group comprising aluminum nitride (AlN) and beryllium oxide ($BeO_2$). The thermally conductive flange 202 circumscribes the annular cylindrical portion 196*a* at the upper portion 232 of the electrical coupler 230 and is attached e.g., by brazing or other thermal bonding/coupling techniques.

FIG. 3B is a detailed view of the circled portion of the electrical coupler 230 shown in FIG. 3A The outer connector element 238 is preferably molded over top 205 and side 204 portions of the thermally conductive flange 202. Notwithstanding a bottom portion 203 of the flange 202, the inner connector 236, resilient banana connectors 199, hollow cylindrical portions 196, and thermally conductive flange 202 are encapsulated and electrically isolated by the outer connector element 238. Moreover, the bottom portion 203 of the thermally conductive flange 202 is in direct contact with the cooling plate 167.

FIG. 4 depicts a top view of the electrical coupler 230. In particular, FIG. 4 depicts the top flange portion 205 circumscribing the resilient banana connector 199*a* and the hollow cylindrical portion 196*a*. The thermally conductive flange 202 comprises a plurality of holes or bores 202*a*, 202*b*, and 202*c* that pass through the thermally conductive flange 202. These bores 202*a*, 202*b*, and 202*c* are used for receiving threaded bolts therethrough, such as representative threaded bolt 202*d*, shown in FIGS. 2 and 3B. This affords mechanical mounting of the upper portion 232 of the electrical coupler 230 to the cooling plate 167. More particularly, as shown in FIG. 2, the thermally conductive flange 202, and accordingly, the upper portion 232 of the electrical coupler 230 is mounted to the annular mounting surface 167*c* by the threading bolts 202*d*. The threading bolts 202*d* engage the corresponding threaded bores 202*a–c* extending inwardly into the mounting surface 167*c*. In this manner, the thermally conductive flange 202 is disposed above the mounting surface 167*c* and in contact with the annular cylindrical portion 196*a*. As such, the cooling plate 167 conducts heat from the upper male connector 231, as well as the upper portion 232 of the electrical coupler member 230, via the thermally conductive flange 202. Specifically, operating temperatures during wafer processing may reach approximately 300° Celsius (C) at the upper male connector 231. The thermally conductive flange 202 produces a thermal path from the upper male connector 231 to the cooling plate 167, where the temperature decreases to less than 150° C. proximate the cooling plate 167. At temperatures less than 150° C., the silicone outer connector element 238, which is disposed over the length of the electrical coupler 230, is not subjected to excessive temperatures that may cause the silicone to deteriorate. Thus, the silicone outer connector element 238 continues to protect the connector 230 from possibly forming a plasma in the inner connector element 236, as well as arcing with surrounding surfaces having voltage potentials less than that of the electrical coupler member 230.

Therefore, the addition of a thermally conductive flange 202 increases the conductivity of heat between the chuck 220 and cooling plate 167 of the semiconductor wafer support 200. Specifically, heat is transferred through a thermal path from the upper male connector 231 coupled to the chuck body 162, through the banana connector 199*a* and hollow annular cylindrical portion 196*a*, through the thermally conductive flange 202, and into the surface of the cooling plate 167. Accordingly, the electrical coupler 230, including the upper male connector 231, are only exposed to temperatures that are less than typical process operational temperatures caused by RF power conduction, plasma environments, and the like.

It will be understood that while the present invention has been shown and described in the context of semiconductor wafer chucks including a single embedded electrode, the present invention is not so limited and is equally applicable to semiconductor wafer chucks including more than one embedded electrode. Although various embodiments that incorporate the teachings of the present invention have been shown and described in detail herein, those skilled in the art can readily devise many other varied embodiments that still incorporate these teachings.

What is claimed is:

1. An electrical coupler, comprising:

an electrically conductive inner connector element having opposing ends;

an upper end connector and a lower end connector; each end connector respectively coupled to one of said opposing ends of said inner connector element;

a thermally conductive flange directly abutted against and circumscribing said inner connector; and an electrically non-conductive outer connector element disposed over said electrically conductive inner connector and said thermally conductive flange.

2. The electrical coupler of claim 1 wherein said thermally conductive flange is brazed to said inner connector.

3. The electrical coupler of claim 1 wherein said thermally conductive flange is fabricated from a ceramic material.

4. The electrical coupler of claim 1 wherein said thermally conductive flange is fabricated from the group comprising aluminum nitride and beryllium oxide.

5. The electrical coupler of claim 1 wherein said inner connector element is fabricated from beryllium copper.

6. The electrical coupler of claim 1 wherein said outer connector element is fabricated from silicone.

7. The electrical coupler of claim 1 wherein a portion of said thermally conductive flange circumscribing said inner connector is exposed from said outer connector element to transfer heat to a surrounding environment.

8. The electrical coupler of claim 1 wherein said thermally conductive flange defines a thermally conductive path from said inner connector to an environment surrounding said electrical coupler.

9. The electrical coupler of claim 1 wherein said opposing ends of said inner connector element each comprise a bore, in which the upper and lower end connectors are disposed.

10. The electrical coupler of claim 9 wherein said upper and lower end connectors each comprise a female banana connector disposed therein said bore.

11. The electrical coupler of claim 9 wherein said upper and lower end connectors are fabricated from beryllium copper.

12. The electrical coupler of claim 11 said upper and lower end connectors are plated with at least one electrical conductor.

13. The electrical coupler of claim 12 wherein said upper and lower end connectors are plated with successive layers of nickel and gold.

14. The electrical coupler of claim 1 further comprising an upper male connector removably inserted into said upper end connector.

15. The electrical coupler of claim 1 wherein said upper male connector is fabricated from a thermally non-conductive material.

16. The electrical coupler of claim 15 wherein said upper male end connector is fabricated from stainless steel.

17. The electrical coupler of claim 15 wherein said upper male end connector is plated with at least one electrical conductor.

18. The electrical coupler of claim 17 wherein said upper male end connector is plated with successive layers of nickel, copper, nickel, gold.

19. The electrical coupler of claim 1 further comprising a lower male connector removably inserted into said lower end connector.

20. The electrical coupler of claim 19 wherein said lower male connector is fabricated from beryllium copper.

21. The electrical coupler of claim 19 wherein said lower male connector is plated with at least one electrical conductor.

22. The electrical coupler of claim 21 wherein said lower male connector is plated with successive layers of nickel and gold.

* * * * *

UNITED STATES PATENT AND TRADEMARK OFFICE

CERTIFICATE OF CORRECTION

PATENT NO. : 6,736,668 B1
DATED : May 18, 2004
INVENTOR(S) : Arnold V. Kholodenko et al.

It is certified that error appears in the above-identified patent and that said Letters Patent is hereby corrected as shown below:

Column 3,
Line 25, please change “materials way be” to -- materials may be --.

Column 7,
Line 4, please change “of claim 1” to -- of claim 14 --.

Signed and Sealed this

Twenty-first Day of December, 2004

JON W. DUDAS
*Director of the United States Patent and Trademark Office*